US010577760B2

(12) United States Patent
Robinson

(10) Patent No.: US 10,577,760 B2
(45) Date of Patent: Mar. 3, 2020

(54) JOINT FORMS AND ASSOCIATED TECHNIQUES FOR REPAIRING AND SEALING CONCRETE EXPANSION JOINTS

(71) Applicant: Glenn Robinson, Camden, AL (US)

(72) Inventor: Glenn Robinson, Camden, AL (US)

( * ) Notice: Subject to any disclaimer, the term of this patent is extended or adjusted under 35 U.S.C. 154(b) by 0 days.

(21) Appl. No.: 16/444,940

(22) Filed: Jun. 18, 2019

(65) Prior Publication Data

US 2019/0390418 A1 Dec. 26, 2019

Related U.S. Application Data

(60) Provisional application No. 62/689,054, filed on Jun. 22, 2018.

(51) Int. Cl.

| | |
|---|---|
| ***E01C 23/09*** | (2006.01) |
| ***E01C 23/16*** | (2006.01) |
| ***E01D 19/06*** | (2006.01) |

(52) U.S. Cl.
CPC ..... *E01C 23/0973* (2013.01); *E01C 23/16* (2013.01); *E01D 19/06* (2013.01)

(58) Field of Classification Search
CPC ..... E01C 23/0973; E01C 23/16; E01C 11/04; E01C 11/106; E01D 19/06; E04B 1/68; E04B 1/6812
See application file for complete search history.

(56) References Cited

U.S. PATENT DOCUMENTS

| | | | | |
|---|---|---|---|---|
| 1,329,631 A * | 2/1920 | Riehle | E01C 11/106 | 404/65 |
| 1,503,942 A * | 8/1924 | Fischer | E01C 11/106 | 404/65 |
| 2,539,875 A * | 1/1951 | Van London | E01C 11/106 | 404/74 |
| 3,276,334 A * | 10/1966 | Rhodes | E01C 11/126 | 404/74 |
| 3,334,557 A * | 8/1967 | Fitzgibbon | E01C 11/103 | 404/64 |
| 4,181,711 A * | 1/1980 | Ohashi | E04B 1/6812 | 428/40.6 |

(Continued)

FOREIGN PATENT DOCUMENTS

WO WO-2014209000 A1 * 12/2014 ..... E01C 11/103

*Primary Examiner* — Abigail A Risic
(74) *Attorney, Agent, or Firm* — Michael J. Mehrman; Mehrman Law Office

(57) ABSTRACT

A joint form is positioned in a damaged expansion joint to allow both sides of the joint to be repaired at the same time. The joint form remains as a permanent part of the repair, which avoids the time consuming conventional process of removing temporary forms, cleaning the repaired surfaces, and inserting an elastomeric seal into the expansion joint. Type-0 joint forms include a block-seal laminate including a foam block layer (e.g., closed-cell polyethylene) laminated to an upper elastomeric seal layer (e.g., closed-cell neoprene) without a stiffener board. Type-1 joint forms include a block-seal laminate with a stiffener board (e.g., fiberglass reinforced plastic or FRP) adhered to one side of the block-seal laminate. Type-2 joint forms include a pair of block-seal laminate panels on either side of a central stiffener board bonded to one side laminated to an upper seal layer. Joint forms may also be utilized to seal undamaged expansion joints.

17 Claims, 9 Drawing Sheets

(56) References Cited

U.S. PATENT DOCUMENTS 4,285,612 A * 8/1981 Betti ..... E01C 11/04 14/73.1
4,401,716 A * 8/1983 Tschudin-Mahrer ..... E01C 11/106 428/317.3
5,130,176 A * 7/1992 Baerveldt ..... B32B 5/32 428/192
5,190,395 A * 3/1993 Cathey ..... E01C 11/10 404/48
5,354,145 A * 10/1994 Sterner ..... E01C 23/06 404/107
5,686,174 A * 11/1997 Irrgeher ..... E04B 1/6812 428/304.4
5,935,695 A * 8/1999 Baerveldt ..... E04B 1/6812 428/218
6,074,128 A * 6/2000 Marino ..... C08L 95/005 404/75
6,183,575 B1 * 2/2001 Embelton ..... E01C 7/147 156/71
6,685,196 B1 * 2/2004 Baerveldt ..... E01C 11/106 277/628
8,813,450 B1 * 8/2014 Hensley ..... E04B 1/6804 52/396.01
9,637,915 B1 * 5/2017 Hensley ..... E04B 1/948
9,719,248 B1 * 8/2017 Meacham ..... E04B 1/6812
9,822,499 B2 * 11/2017 Yan ..... E01D 21/00
2004/0187235 A1 * 9/2004 Elias ..... E01C 11/12 14/73.1
2005/0036834 A1 * 2/2005 Shaw ..... E01C 11/14 404/47
2008/0268231 A1 * 10/2008 Deib ..... E04B 1/6812 428/323
2009/0246498 A1 * 10/2009 Deiss ..... E04B 1/68 428/220
2010/0307102 A1 * 12/2010 Barnett ..... E01C 11/10 52/741.4
2014/0151968 A1 * 6/2014 Hensley ..... E04B 1/6812 277/654
2014/0219719 A1 * 8/2014 Hensley ..... E01C 11/14 404/57
2017/0121918 A1 * 5/2017 Yan ..... C04B 26/14
2017/0284083 A1 * 10/2017 Hensley ..... E04B 1/6812
2017/0328016 A1 * 11/2017 Busch ..... E01C 11/06
2018/0163349 A1 * 6/2018 Danna ..... E04B 1/6812
2018/0163393 A1 * 6/2018 Danna ..... E01C 11/106
2018/0363292 A1 * 12/2018 Robinson ..... E04B 1/948
2019/0063608 A1 * 2/2019 Robinson ..... E04B 1/681

* cited by examiner

JOINT FORMS AND ASSOCIATED TECHNIQUES FOR REPAIRING AND SEALING CONCRETE EXPANSION JOINTS

REFERENCE TO RELATED APPLICATION

This application claims priority to U.S. Provisional Patent Application Ser. No. 62/689,054 filed Jun. 22, 2018, which is incorporated by reference.

TECHNICAL FIELD

The present invention is directed to concrete repairs and, more particularly, to joint forms and associated techniques for repairing and sealing expansion joints in concrete decks, such as those on roads, bridges, culverts, levees and the like.

BACKGROUND

Concrete decks typically include a series of concrete sections or slabs separated by expansion joints. The expansion joints allow the adjacent deck sections to move a small amount with respect to each other to reduce cracking caused by settling, thermal expansion, vibration, load flex, wind load and other types of movement. Nevertheless, normal wear and tear including heavy loads, freeze-thaw cycles and other stresses expose the deck sections to spalling concrete loss at the expansion joints, eventually creating potholes. Occasional maintenance is therefore required to repair and stop the progression of the damage.

Repairing concrete damage at an expansion joint is complicated because simply filling the expansion joint as part of the repair is inadvisable. This is because filling the expansion joint with concrete repair material effectively defeats the purpose of the expansion joint, causing the repair material to crack and spall quickly due to relative movement of the adjacent slabs. Conventional approaches to preserving the expansion joint while repairing the damage typically involves a two-stage repair technique that requires closing the road for an extended period, which can lead to detours and extreme congestion. For example, the prevailing concrete deck repair technique uses forms temporarily placed along each slab of the expansion joint, which are backfilled with concrete repair material. The forms are then removed with the aid of a bond breaker and the patch is allowed to cure overnight. The road crew returns the next day (weather permitting) to clean the bond breaker from the repaired surfaces and install a neoprene, silicone rubber, or silicone rubber caulk seal into the expansion joint to prevent water, sand and other debris from infiltrating the joint. The repair process requires closing the roadway for at least two times, which can be extremely disruptive to the traffic. In some cases, the road crew may have to repair each side of expansion joint on separate days, which further extends the repair process.

At present, conventional concrete repair techniques do not allow a damaged expansion joint to be repaired and sealed in a single repair session. There is, therefore, a need for improved techniques for repairing and sealing concrete damage at expansion joints.

SUMMARY

The present invention meets the needs described above through a joint form and seal that is positioned in a damaged expansion joint to allow both sides of the joint to be repaired at the same time. The joint form remains as a permanent part of the repair, which avoids the time consuming conventional process of removing temporary forms from the expansion joint, cleaning the repaired surfaces, and inserting an elastomeric seal into the expansion joint. Embodiments include a method for using the joint form to repair and seal a damaged expansion joint along with several different types of joint forms suitable for repairing damaged areas of different sizes and configurations. Type-0 joint forms include a block-seal laminate including a foam block layer (e.g., closed-cell polyethylene) laminated to an upper closed-cell elastomeric seal layer (e.g., closed-cell neoprene) without a stiffener board. Type-1 joint forms include a block-seal laminate with a stiffener board (e.g., fiberglass reinforced plastic or FRP) adhered to one side of the block-seal laminate. Type-2 joint forms include a pair of block-seal laminate panels on either side of a central stiffener board bonded on one side to the foam block material and laminated to an upper seal layer. The joint form may also be utilized to seal an undamaged expansion joint.

It will be understood that specific embodiments may include a variety of features in different combinations, as desired by different users. The specific techniques and systems for implementing particular embodiments of the invention and accomplishing the associated advantages will become apparent from the following detailed description of the embodiments and the appended drawings and claims.

BRIEF DESCRIPTION OF THE FIGURES

The numerous advantages of the embodiments of the invention may be better understood with reference to the accompanying figures.

DETAILED DESCRIPTION

Figure 1A:
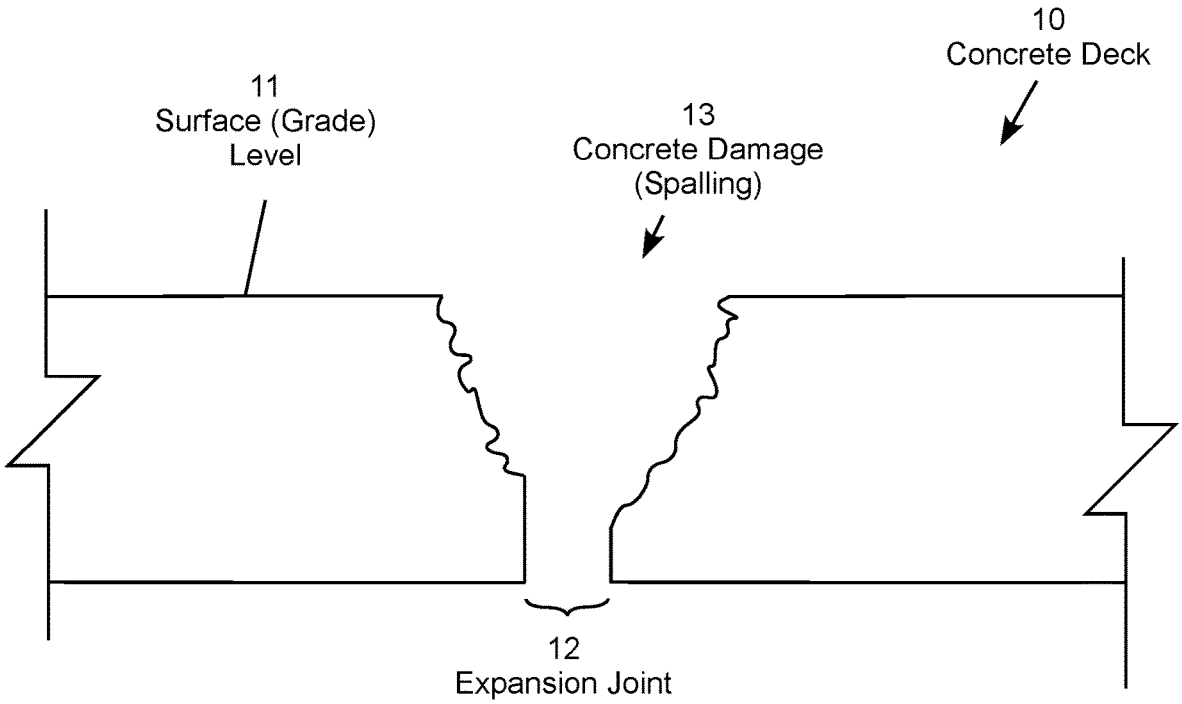
FIG. 1A is a side view of a representative concrete deck with spalled concrete damage at an expansion joint.

Since the introduction of modern general purpose polymer concretes (e.g., RESURF®LR and RESURF®II), concrete deck failures at expansion joints have been repaired in a multi-visit process requiring a road closure over at least two site visits on at least two different days. This requires extended road closures and associated disruption to the traffic pattern. Embodiments of the invention revolutionize expansion joint repair and seal into a single-visit process reducing the road closure to a single event of two to three hours. The innovative repair procedure utilizes a joint form that includes a foam block layer (e.g., closed-cell polyethylene) topped with an elastomeric seal layer (e.g., closed-cell neoprene) that becomes a permanent part of the repaired expansion joint. The innovative joint form expands, contracts and flexes sufficiently to accommodate slight movement of the concrete slabs while preventing or minimizing cracking or spalling of the repaired joint. The joint form may also be utilized to seal an undamaged expansion joint. The upper neoprene layer maintains a tight seal to keep water, sand and other materials out of the repaired joint. This layer also effectively blocks UV light.

A joint form blank is typically constructed off site and cut to size at the job site. The properly sized joint form is then installed into the expansion joint spanning the region of concrete damage and extending up to (or close to) the surface grade level. Primer applied to the joint form acts as a lubricant to facilitate installation of the joint form into the damaged expansion joint. The regions around both sides of the joint form are then primed and backfilled with concrete repair material, followed by finishing to grade level on both sides expansion joint. The concrete repair material is then allowed to cure on both sides of the expansion joint with the joint form remaining in place, which allows the repair to be completed during a single site visit. In most cases, the repair is completed during a single road closure in the two to three hour range. The innovative procedure replaces the conventional multi-day repair process that includes installing temporary forms, priming, back filling, partial curing, bond breaking and form pulling on the first day. After overnight curing, the road crew returns for sandblast cleaning to remove bond breaker residue and prepare the repaired surfaces followed by sealing with an elastomeric material on the second day. The joint form thus simplifies the arduous tasks used in conventional expansion joint repair using temporary forms into an efficient process performed during a single road closing.

Historically failed and polymer concrete repaired bridge joints have been formed in a variety of ways intended to do no further damage to the repaired faces during the cure phase. A variety of usually layered materials with some sort of bond breaker has been employed since about 1985 or before. After the polymer concrete nosings have sufficiently cured, the temporary forms are removed with the aid of a bond breaker. This is often completed after the concrete repair material has partially cured for a few hours. Usually during a second site visit the next day (weather permitting) or later, while the road remains closed (or in some cases closed a second time), the faces of the repair are sandblasted to clean the surfaces of bond breaker residue and plug voids to prepare the nosings for sealing. An elastomeric seal is then inserted into the repaired expansion joint and secured with a bonding agent to seal the joint. In some cases, each side of the expansion joint is repaired separately, further increasing the number of site visits required to complete the repair. Multiple site visits result in extended or multiple road or lane closures and associated traffic disruptions, adversely affecting the quality of the repair, reduces safety, and significantly increases labor and materials costs. Embodiments of the invention offer a much more efficient and versatile approach capable of handling irregular broken concrete bridge deck joints during a single site visit and associated road or lane closure.

Concrete failures or jackhammer breakouts at expansion joints are often as bad or worse (hulled out) at the bottom than at the top of the slab. The benefits of medium to low modulus foam materials has long been known and employed by repair crews to plug leaks during placement of the fresh polymer concrete. Embodiments of the invention reduce material costs, reduce repair time to a single site visit, and make the overall system more user-friendly by filling 60-90% of the expansion joint with closed-cell foam block, such as polyethylene, topped with a layer of an elastomeric seal material, such as closed-cell neoprene. For example, a joint form blank may be constructed by gluing a 1-inch layer of closed-cell neoprene foam on top of 2 to 10 inches of closed cell polyethylene foam (e.g., Ethafoam®) in advance of any particular joint repair job. The joint form blank is then cut to size and installed on the job site at the time of the joint repair.

The smooth (unsawed) surface of the foam block is typically bonded to the smooth (unsawed) surface the neoprene layer with an appropriate adhesive, such as a brushed-on contact adhesive. For example, a joint form blank may be constructed by gluing a one-inch layer of closed cell neoprene to one to five two-inch thick sheets (2-10 inches) closed cell polyethylene foam with brushed-on contact cement. Form blanks are then constructed by sawing the laminate with a bandsaw, generally into ½-inch to 2-inch thick slices, 3 to 11 inches tall, usually 6.5 feet to 8.0 feet long. To provide one representative example, a number of joint form blanks 2 inches wide, 7 inches tall (i.e., 1-inch neoprene on top of 6-inch polyethylene), and 8 feet long may be constructed in advance of any particular job. A selected joint form blank is then trimmed to the desired height and length at particular job site when needed for a particular expansion joint repair.

The joint form is particularly well suited for bonding to typical concrete repair materials, such as polymer concrete, mortar and other resin-based materials. Once the sides of the joint form are sawed to the desired width, most of the closed cells (bubbles) at the side surfaces are severed in the path of the saw blade. These "opened" bubbles at the side surfaces afford a very effective mechanical bond with resin-based, such as polymer concrete and thin mortar, that penetrates the opened bubbles and then polymerizes (hardens). Since the joint form remains in the expansion joint as part of the repair, there are no temporary forms to remove and no repaired faces to clean and prepare for sealing. After the concrete repair material hardens, the closed-cell foam block (e.g., polyethylene) and closed-cell elastomeric seal (e.g., neoprene) expand, contract and flex sufficiently to accommodate the relative movement of the concrete slabs without causing the original concrete or the concrete repair material to crack or spall. The joint form bonded into the repaired expansion joint is also very effective at sealing the joint to prevent water, sand and other debris from infiltrating the repaired portion of the expansion joint. For this reason, a joint form can be bonded into an expansion joint to effectively seal the joint even in the absence of a concrete repair.

Installing the joint form into the expansion joint may be facilitated by using primer to lubricate and then temporarily hold the joint form in place while the form is backfilled with concrete repair material. For example, when the joint form is primed with catalyzed priming resin, the primer initially acts as a lubricant to facilitate tight insertion of the joint form into the expansion joint. After gelation, the primer hardens sufficiently to secure the joint form in place with the top of the seal layer (e.g., neoprene) at the desired position at or near the grade level while the concrete repair material (e.g., polymer concrete or mortar) is backfilled on one or both sides of the joint form and finished to grade level.

By utilizing closed-cell foam block (e.g., polyethylene) foam block for the bottom 60-90% of the joint form, joint sealing and integrity of the expansion joint is enhanced due to lower density (compressive modulus) of the polyethylene foam. For irregular joints (e.g., varying width of joint and size of breakouts) especially at the bottom of the bridge deck slab, the polyethylene foam can be easily sliced, carved, sanded and layered to shape the joint form to fit surfaces to be repaired. An additional advantage of the opened cell surface of the cut polyethylene foam block is that very large sections of concrete damage can be plugged and repaired successfully with split pieces of polyethylene foam (e.g., SealSil® ¼-inch thick, 4-inch to 6-inch wide polyethylene rolls) or even cannabalized pieces of polyethylene block or joint form laminate (neoprene foam on top of polyethylene foam block). Multiple pieces of polyethylene block or joint form laminate can be glued in place, as necessary, with contact adhesive or catalyzed polymer concrete resin. This may be desirable to plug all potential leaks of repair mortar or polymer concrete, reduce the amount of concrete repair material required, and to position the top of the joint form at or slightly below grade of the grade level of the concrete deck.

An important advantage is that the joint form bonds strongly to the concrete repair material forming a strong seal that is very effective at blocking most if not all larger particle non-compressibles from entering the joint, falling through and building up on the bridge cap below. Non-compressibles on the bridge caps impede designed expansion movement of the girder. This damages girders and caps and can make the bridge or span fall. Many millions of bridge joints need cleaning by DOT crews annually. The innovative joint forms, which remain in place in repaired joints, helps to prevent this type of girder damage from occurring.

The innovative joint form makes the final installation much more aesthetically pleasing. Joint forms may be used for concrete repair as well as sealing expansion joints without concrete repair. All considerations for expansion joint sealing with or without repairs apply to any kind of horizontal or vertical joint. The added benefit and value of easy and quick forming and leaving the form in place on bridge decks and concrete panel pavement is very significant. Work windows and associated lane closures are typically reduced to only a few hours before returning to traffic.

Different types of joint forms may be used depending on the size and configuration of the damage to be repaired. Roadway bridge deck, culvert, and levee joint sealing, with or without failed joint repairs, can be effected with several design alternatives. For any width of designed expansion joint, it may be desirable to stiffen the relatively low modulus polyethylene foam materials. When the concrete joint is significantly broken on both sides, the forming and sealing material tends to bend and become serpentine, and may also tend to lay over onto one or both sides of the joint when much denser repair material (polymer concrete) is placed, consolidated and finished to grade. Thinner joint forms are more prone to the loss of position integrity of the low flexural modulus foam.

Three types of joint forms address a range of joint widths, damage, and movement with contraction and expansion. Type-0 joint forms with no stiffener are usually suitable for joints with one or both slab faces still intact or where very little concrete is broken out. If one or both sides of the expansion joint to be repaired are still intact, stiffening may not be necessary for directional integrity, but may aid in insertion into deep and irregular joints. In addition, when sealing only, where no polymer concrete repairs are necessary, stiffening is usually not necessary. For example, Type-0 joint forms 2 inches to 3 inches tall may often be inserted into the top 2 to 3 inches of the joint for a sealing application. On the other hand, a broken bridge joint requiring a joint form 6 inches more in height may require joint forms with a stiffener board.

A Type-1 joint form includes a fiberglass reinforced plastic (FRP) stiffener board attached to one side of the polyethylene-neoprene laminate when the joint form blank is constructed. The stiffener board is typically attached to the low modulus polyethylene and neoprene foams in a similar manner to the construction of the polyethylene-neoprene laminate, for example with brushed-on catalyzed resin. The Type-1 joint form can ordinarily be primed and installed into a damaged expansion joint like Type-0 joint form. The FRP stiffener board is micro-lugged with the same resin and catalyst used for the polymer concrete repair material to the open cell surface of the sawed foam boards. The outside (non-bonded side) of the pre-cured FRP stiffener is profiled for bonding to the concrete repair material, for example by wire brushing, sanding, lightly sandblasting, chemical priming, or lightly broadcasting with a fine aggregate, such as sandblasting. This allows the exposed surface of the FRP stiffener board, as well as the polyethylene-neoprene laminate, to afford good bonds with any resin-based concrete repair material.

A Type-2 joint form has sawed closed-cell foam panels attached to one side of a central FRP stiffener board. Type-2 joint forms are generally suitable for large damaged areas and large joint movement and keeps the polyethylene foam (only) material bonded (micro-lugged) on both sides of the joint. An illustrative embodiment includes two layers with a central FRP stiffener board bonded to the foam block material on one side between polyethylene-neoprene laminate foam boards, and an upper neoprene seal layer bonded on top of the underlying three-layer laminate. Only the polyethylene portion is glued to the FRP stiffener board, with the neoprene portions left unglued to the FRP stiffener board. As another option, the outer surface of the neoprene foam may be coated with grease (open cells filled) to prevent micro-lugged mechanical bonding to the concrete repair material. This also prevents the polymer concrete repair material from sticking to the top of the neoprene for a neater job.

Often failed bridge deck joints have broken out in a very irregular fashion. After inserting a joint form, it may be necessary to plug holes or voids with additional pieces of foam polyethylene backer rod or scrap pieces of joint form. Stiffeners in Type-1 and Type-2 joint forms aid significantly in keeping the joint form straight longitudinally along the expansion joint and vertically at the top of the joint when plugging voids to prevent leaking joint repair material through onto the bridge cap.

Type-0 and Type-1 joint forms rely on a very strong micro-lugged (mechanical) bond to the concrete repair material. Maximum contraction occurs at very cold temperatures when the foam materials experience their highest tensile modulus. In other words, cold temperatures cause the concrete slabs to contract while also causing the foam material to stiffen. As a result, it is likely that failures will occur, if at all, at cold temperatures with the joint form breaking internally or separating at the bonded surface with the concrete repair material. In either case, the low modulus foam materials (e.g., neoprene and polyethylene) expand, contract and flex more readily than the concrete repair material, and may ultimately fail first in response to concrete slab movement, leaving the concrete repair material and the concrete slabs intact. Most bond failures will occur on only one side of the joint form, therefore the seal remains functional.

Figure 1B:
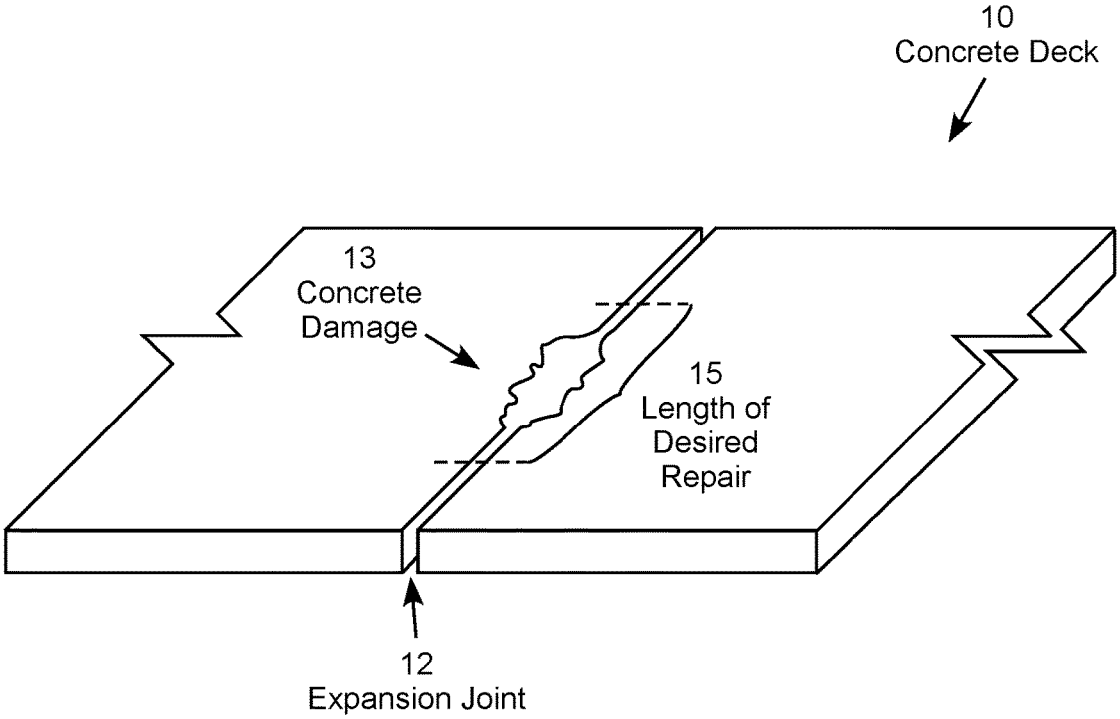
FIG. 1B is a perspective view of the concrete deck showing the spalled concrete damage on the top of the deck.

FIG. 1A is a side view of a representative concrete deck 10 having a surface (grade) level 11 includes an expansion joint 12 that has experienced concrete damage 13 at the expansion joint. For example, the concrete deck 10 may represent a road section, such as a roadway or a lane of a roadway. FIG. 1B is a perspective view of the concrete deck 10 showing the concrete damage 13 on the top of the deck. In this example, substantial concrete loss (spalling) has occurred on both sides of the expansion joint 12 along an extended portion of the deck. For example, the concrete deck 10 may represent a 12-foot wide roadway lane with the concrete damage 13 extending along a 3-foot section of the lane with a varying width up to a foot across. The innovative joint form technique allows this type of road damage to be repaired and sealed in a single 2-hour to 3-hour site visit and associated road or lane closure. To effect the repair, a joint form may be inserted into the entire width of the expansion joint 12, which has the advantage of sealing the entire expansion joint. At a minimum, the joint form 20 is inserted into the expansion joint 12 extending over desired length of repair 15, which should include the length of the concrete damage 13 and at least a foot or so on either side of the damage.

Figure 2A:
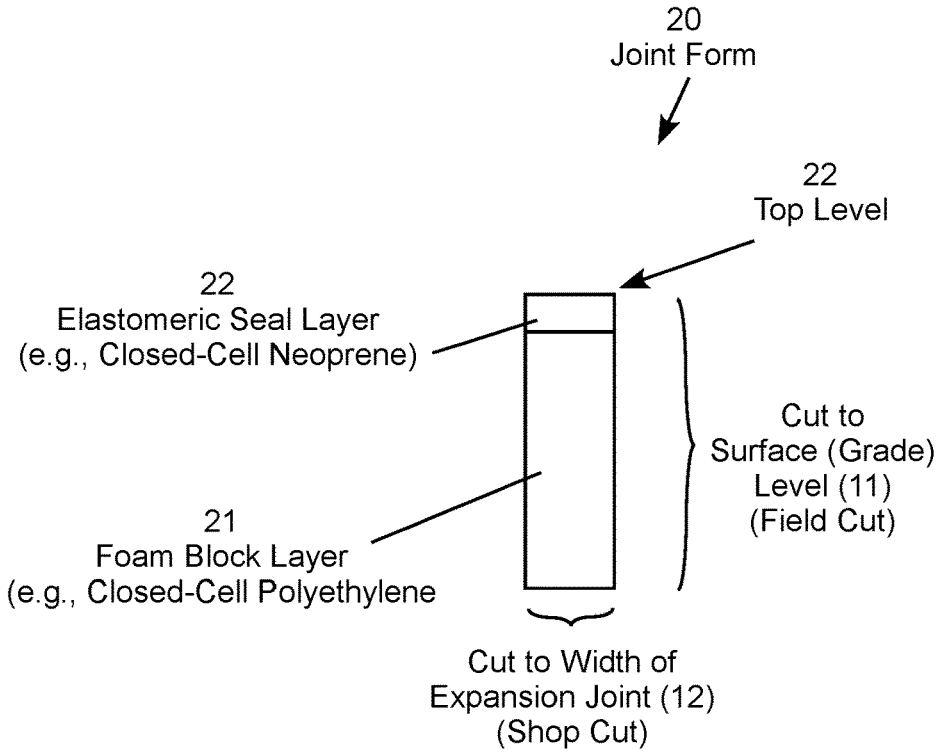
FIG. 2A is a side view of a representative joint form for repairing the expansion joint.
Figure 2B:
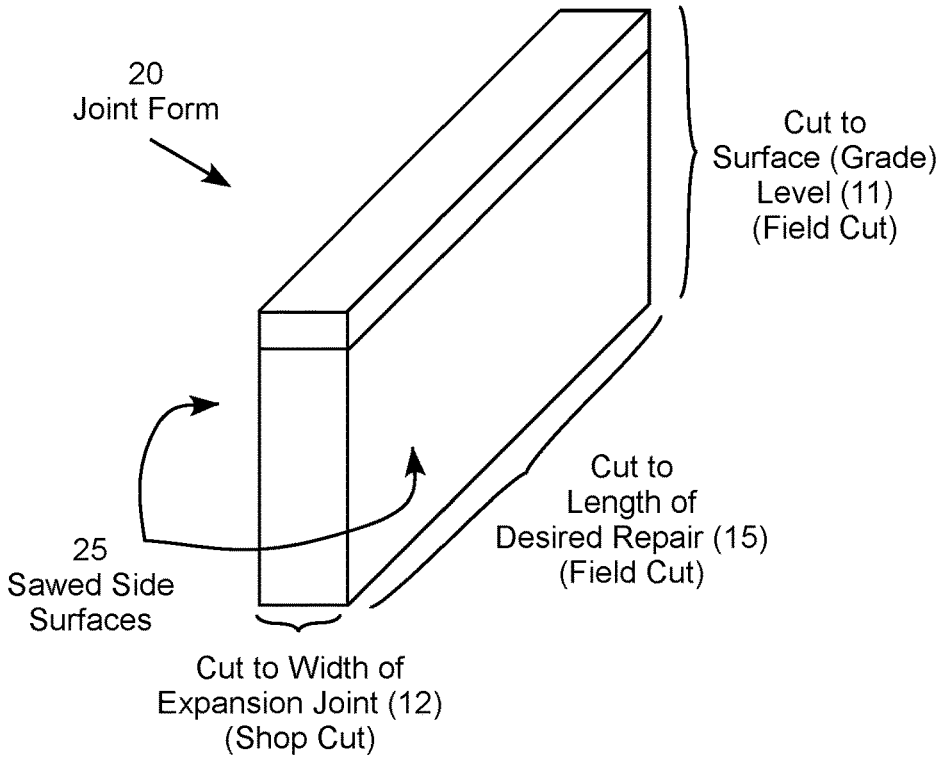
FIG. 2B is a perspective view of the joint form.

FIG. 2A is a side view of a representative joint form 20 for repairing the concrete damage 13, and FIG. 2B is a perspective view of the joint form. A joint form blank that is equal to or larger than the required joint form 20 in each dimension is typically construction off-site prior to the repair job. Joint blanks of various sizes and lengths may be fabricated with a suitable blank selected for the particular repair at the tie of the repair. In this example, the joint form 20 includes a foam block layer 21 (e.g., closed-cell polyethylene) bonded to an upper elastomeric seal layer 22 (e.g., closed-cell neoprene), typically with brushed-on contact cement. As one particular embodiment, the joint form 20 may include a five-inch polyethylene foam block layer 21 bonded to a one-inch neoprene elastomeric seal layer 22 for a total height of six inches. For the illustrative repair, the joint form blank is cut and trimmed so that the joint form 20 matches the width of the undamaged portion of the expansion joint 12, the height of the expansion joint 12 to the surface (grade) level 11, and the length of the desired repair 15. The elongated side surfaces 25 of the joint form 20 are typically cut with a band saw to sever most of the closed-cell bubbles on the side surfaces, which creates excellent surfaces for strongly bonding to any resin-based concrete repair material, such as polymer concrete or mortar.

Figure 3A:
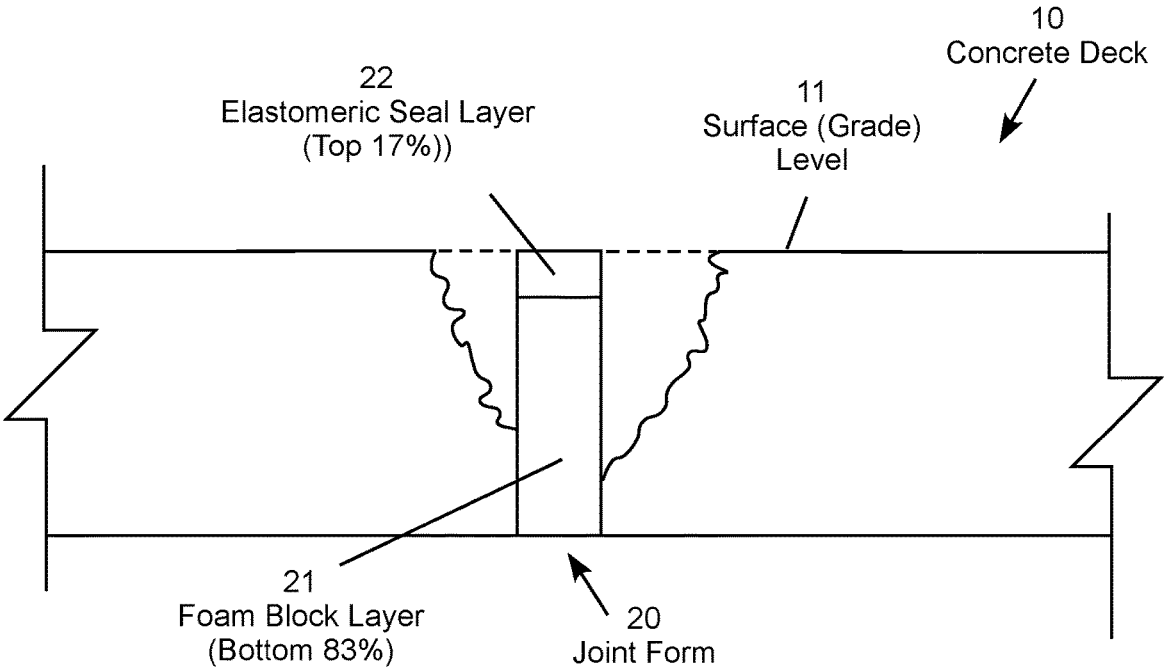
FIG. 3A is a side view of the concrete deck with the joint form positioned in the expansion joint.
Figure 3B:
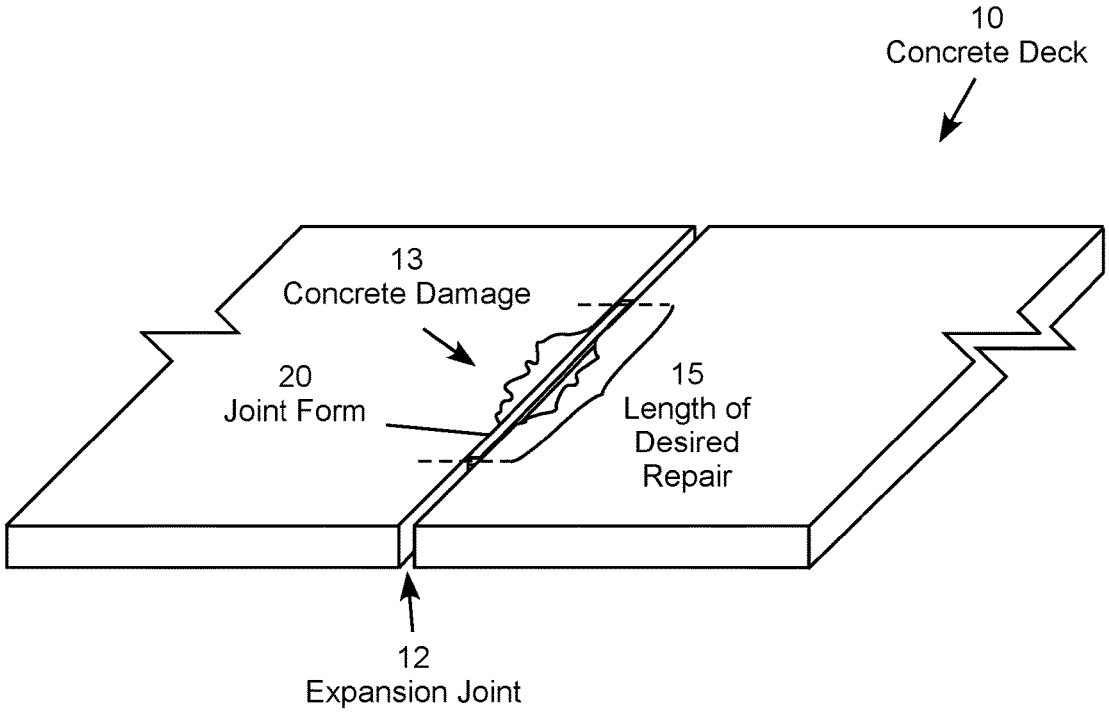
FIG. 3B is a perspective view of the concrete deck with the joint form positioned in the expansion joint.

FIG. 3A is a side view and FIG. 3B is a perspective view of the concrete deck 10 with the joint form 20 positioned in the expansion joint 12 spanning the concrete damage 13. The foam block (polyethylene) layer 21 constitutes the bottom 83% of the joint form, while the elastomeric seal (neoprene) layer 22 constitutes the top 17% of the joint form. The joint form 20 is chosen to closely match the width of the undamaged portion of the expansion joint 12 and trimmed to fill the full height of the expansion joint 12 so that the top of the elastomeric seal layer 22 is positioned at or near the surface (grade) level 11. The length of the joint form is cut to match the length of the desired repair 15.

Figure 4A:
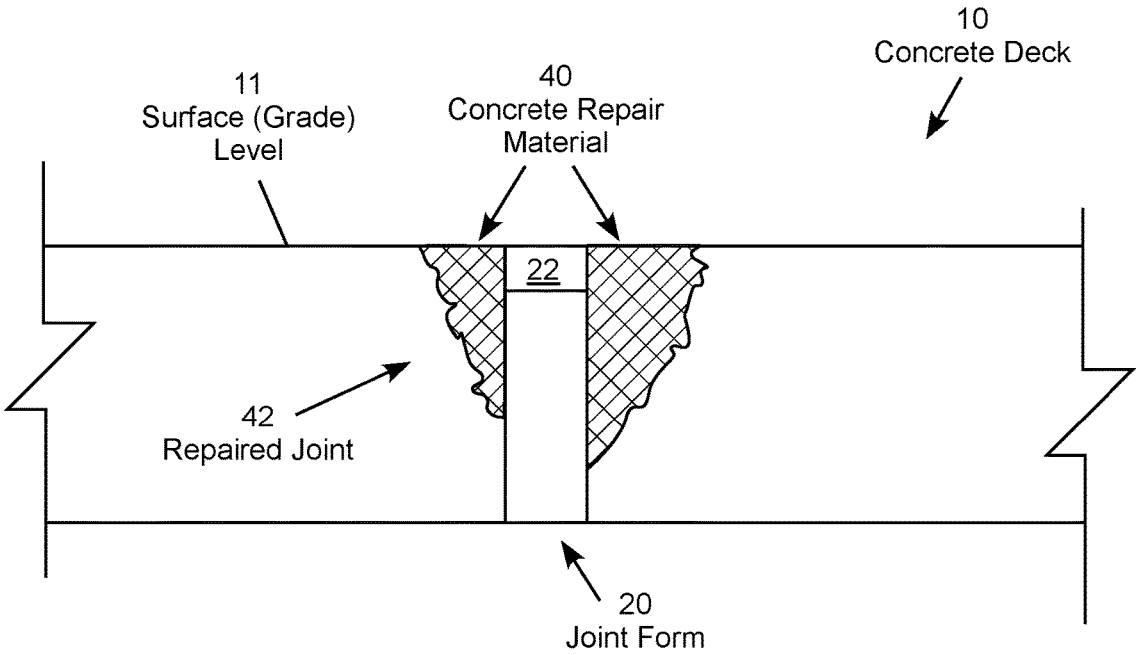
FIG. 4A is a side view of the concrete deck with the concrete damage repaired.
Figure 4B:
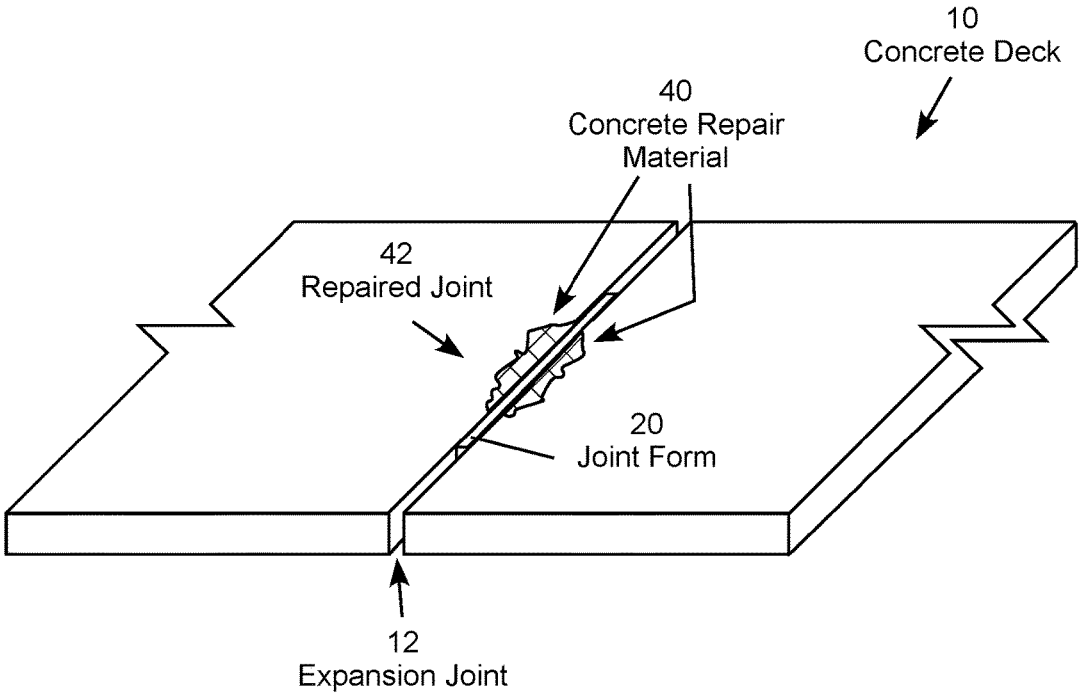
FIG. 4B is a perspective view of the concrete deck with the concrete damage repaired.

FIG. 4A is a side view and FIG. 4B is a perspective view of the concrete deck 10 with the concrete damage repaired by backfilling both sides of the joint form 20 with a concrete repair material 40, such as polymer concrete or mortar, to create the repaired joint 42. For concrete damage of the illustrated size, polymer concrete is typically used as the concrete repair material, while a resin-based mortar may be used when the backfill is thinner. Only primer is typically used along the undamaged portion of the expansion joint 12, while polymer concrete or mortar is used along the concrete damage 13 where more backfill material is required. A screed is typically used to featheredge the top of the concrete repair material 40 to the surface (grade) level 11 with the elastomeric seal 22 on the top of the joint form 20 at or slightly below the surface (grade) level.

Figure 5:
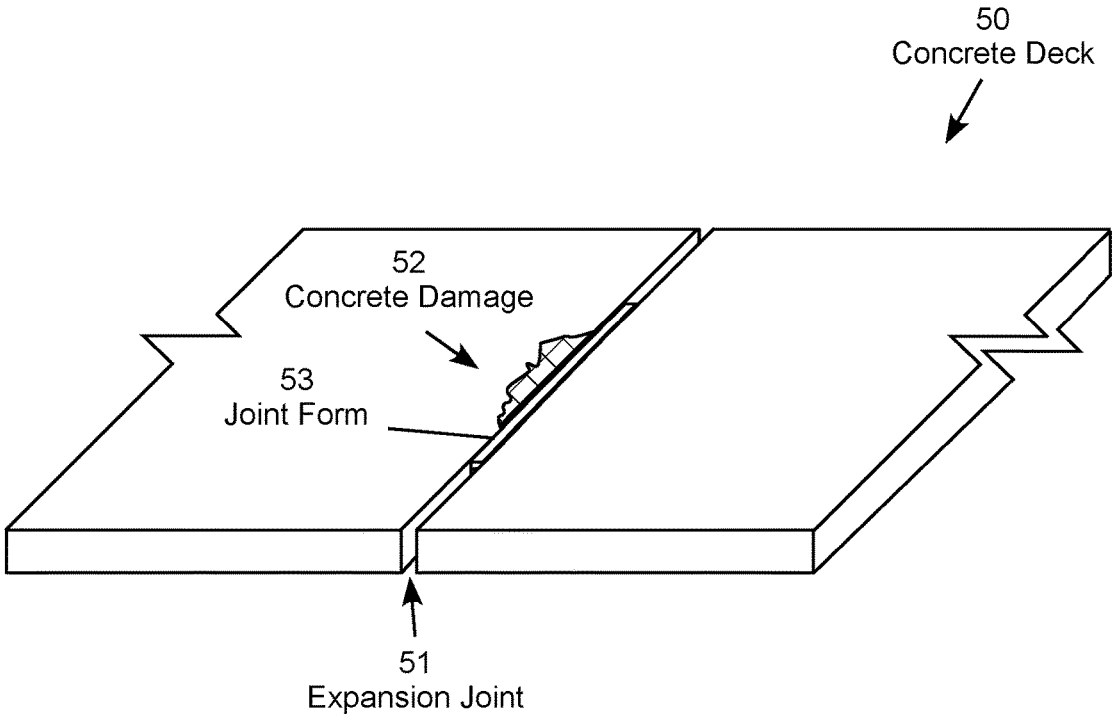
FIG. 5 is a perspective view of concrete deck with a joint form repair to concrete damage on only one side of an expansion joint.
Figure 6:
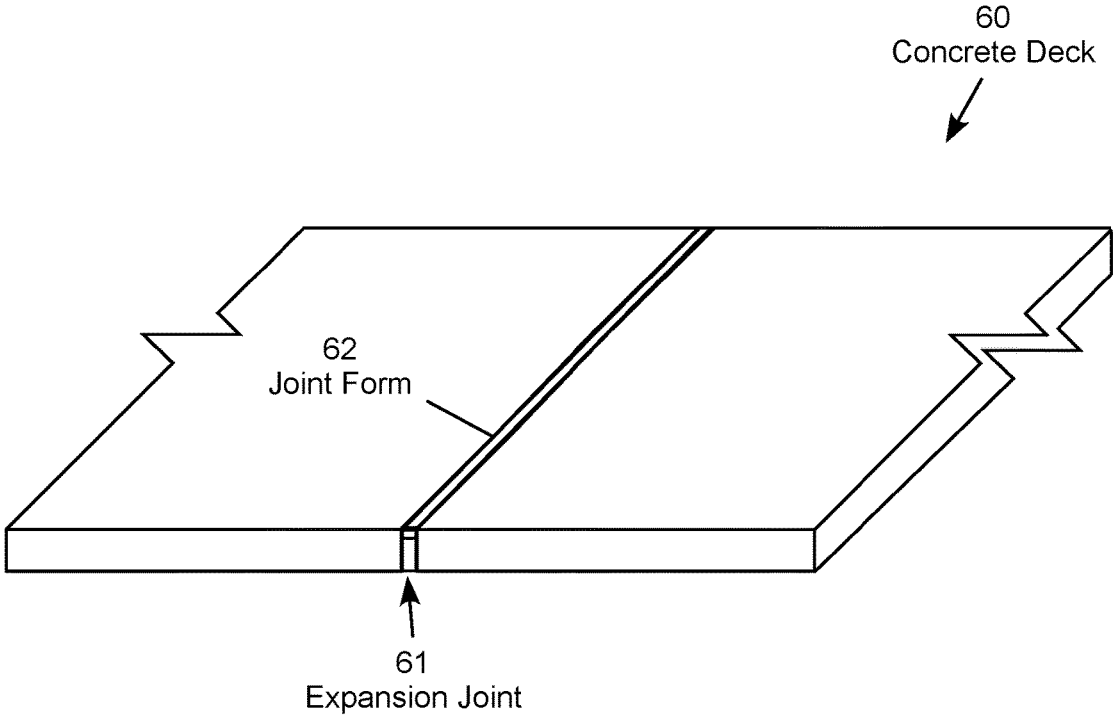
FIG. 6 is a perspective view of concrete deck with a joint form used to seal an undamaged expansion joint.

The joint form technique can also be used to repair concrete damage on only one side of an expansion, and to seal an undamaged expansion joint. To illustrate this embodiment, FIG. 5 is a perspective view of concrete deck 50 with an expansion joint 51 with concrete damage 52 on only one side of the expansion joint. The concrete damage 52 has been repaired with joint form 83 using the joint form repair and seal technique.

Figure 9:
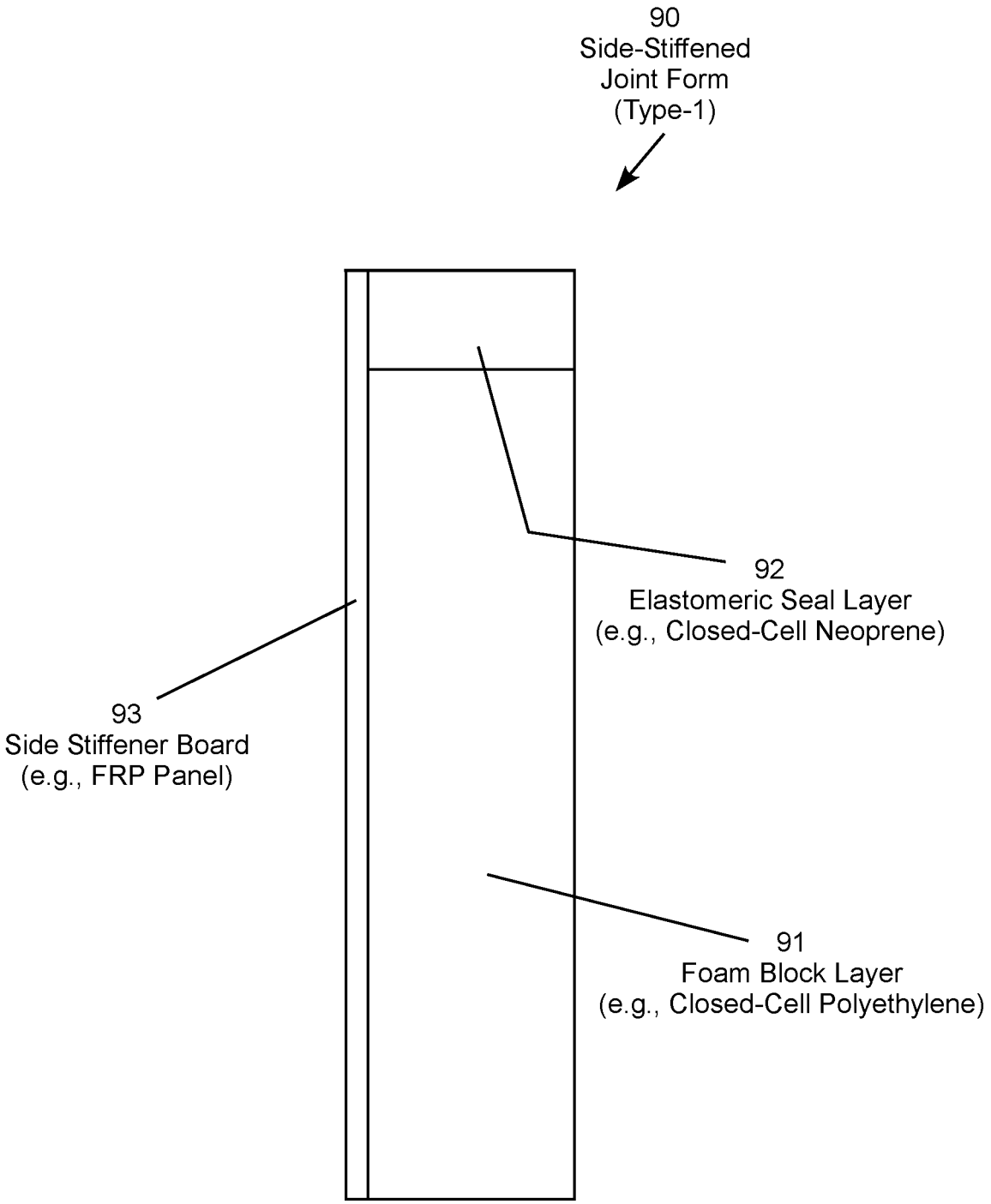
FIG. 9 is a side view of a first alternative joint form with a side stiffener.

In another embodiment, FIG. 9 is a perspective view of concrete deck 60 with an undamaged expansion joint 61 that has been sealed with a joint form 62 that extends all the way across the concrete deck. An adhesive, such as primer or another adhesive with a suitable setting time, is applied to the joint form to facilitate installing the joint form into the expansion joint. The adhesive also serves to bond the joint form within the expansion joint once it sets. The sealing application can typically be completed during a relatively short road or lane closure, typically less than one hour.

It will be appreciated that a joint form that extends all the way across the concrete deck, or a selected portion of the decks such as a road lane, may be used to both seal and repair concrete damage on only one side or both sides of the expansion joint. For sealing and repair applications, the joint form may be sized to fill the full height or any desired portion of the height of the expansion joint, such as the top three or four inches of a deeper expansion joint. Regardless of whether the joint form is sized to fill the full height or a smaller desired portion of the height of the expansion joint, the height of the joint form is described as "corresponding to the height of the expansion joint," as that term is used in this specification, provided that the joint form is sized to fit within the expansion joint with the top of the joint form at or slightly below the surface level of the deck, typically less than ¼-inch below the surface level of the deck.

Figure 7:
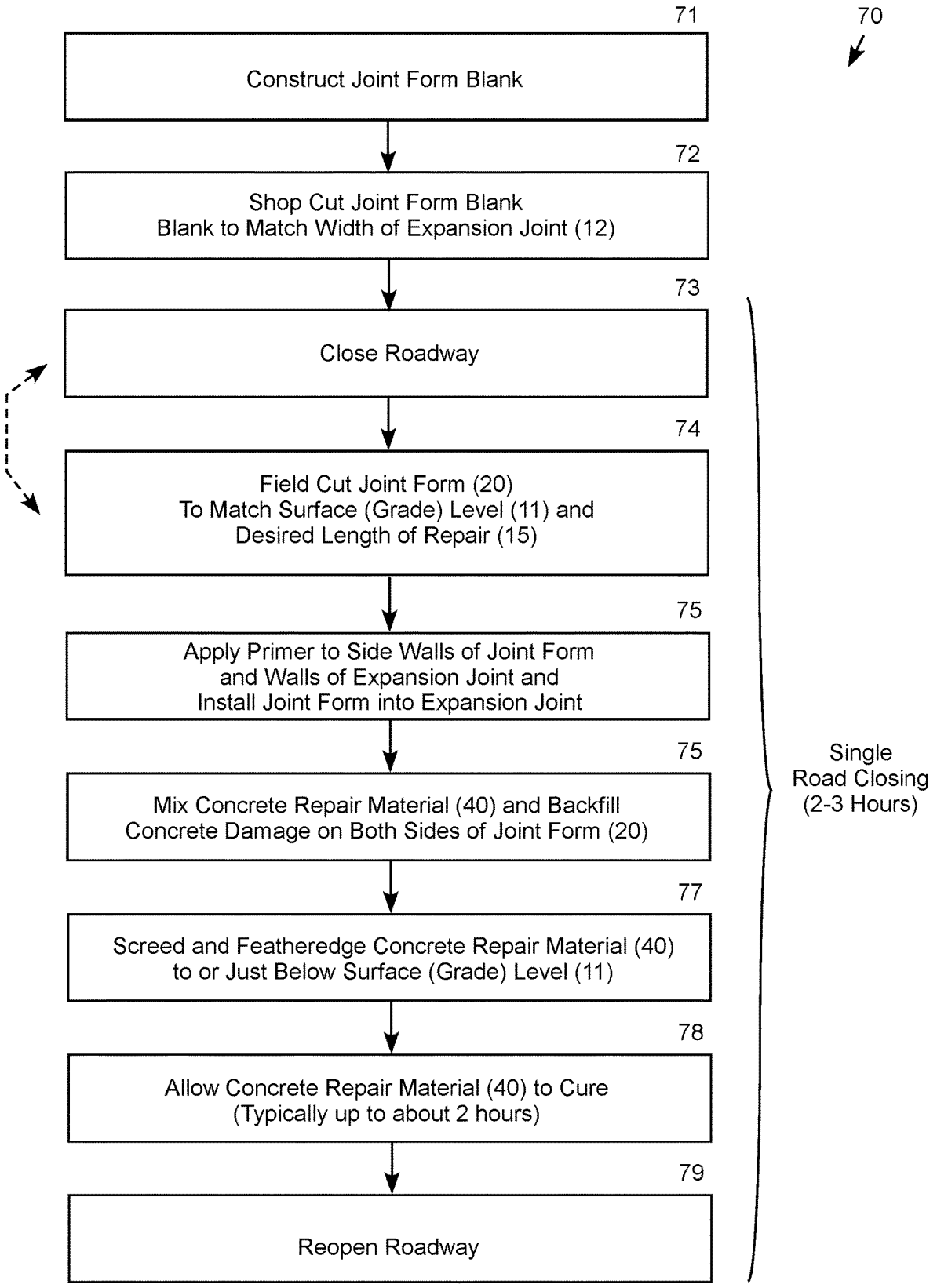
FIG. 7 is a logic flow of a method for using a joint form to repair and seal concrete damage at an expansion joint in a concrete deck.

FIG. 7 is a logic flow of a method 70 for using a joint form to repair concrete damage at an expansion joint in a concrete deck. The concrete repair job illustrated in FIGS. 1A-1B through 4A-4B will be used as an illustrative example. In step 71, a number of joint form blanks of varying sizes and lengths are fabricated, typically at a shop location, for later use on various job sites. This allows steps 72 through 78 to be subsequently performed at a repair site during a single road or lane closure.

Step 71 is followed by step 72, in which the form blank is cut in the shop, typically with a band saw, to the width of the expansion joint (12). The form blank is typically sawed on both sides to open the cells to allow the joint form to bond strongly to the concrete repair material or other adhesive. A number of joint form blanks may be cut to the typical widths of expansion joints and stored for later use. For example, joint form blanks with ½-inch thickness, ¾-inch thickness, 1 inch thickness, 1 and ½-inch thickness, and 2-inch thickness (or other thicknesses, as desired) may be cut and stored later use on expansion joint repair jobs. Step 72 is followed by step 73, in which the roadway is closed at a particular job site to repair the concrete damage 13 at the expansion joint 12 in the concrete deck 10, such as a bridge deck. Step 73 is followed by step 74, in which the blank is cut and trimmed to construct a joint form 20 matching the surface (grade) level 11, the width of the undamaged portion of the expansion joint 12, and the length of the desired repair 15. Note that step 74 may be performed before step 73 to further reduce the road or lane closure time if a proper measurements can be obtained before closing the road or lane, for example from measurements taken before the time of repair or photographs of the concrete damage. In this case, step 74 (i.e., trim the joint form blank to the desired dimensions) may be performed away from the repair site prior the road crew arriving at the repair site. Step 74 is followed by step 75, in which primer is applied to the elongated sides 25 of the joint form 20 and the walls of the expansion joint 12 along the length of the desired repair 15. The primer serves as a lubricant to facilitate inserting the joint form 20 into the expansion joint 12 along the length of the desired repair 15, typically with a snug fit along the undamaged portion of the expansion joint. The joint form 20 is manually held in place with the top of the joint form at or near the surface (grade) level 11 while the primer sets sufficiently to hold the joint form in place.

Step 75 is followed by step 76, in which the selected concrete repair material 40 is mixed, typically in a wheelbarrow or mortar mixer, and backfilled on both sides of the joint form 20. Step 76 is followed by step 77, in the concrete repair material 40 may be prodded and tamped to eliminate voids, screed on top, and featheredged to the surface level 11. Step 77 is followed by step 78, in which the concrete repair material 40 is allowed to cure, typically about two hours for larger repairs and somewhat less for smaller repairs. Step 78 is followed by step 79, in which the roadway or lane is reopened after a single road or lane closing event in the range of 2 to 3 hours. Those skilled in concrete deck repair will appreciate that this constitutes a major improvement over the conventional techniques for concrete deck repair requiring multiple site visits on multiple days.

Figure 8:
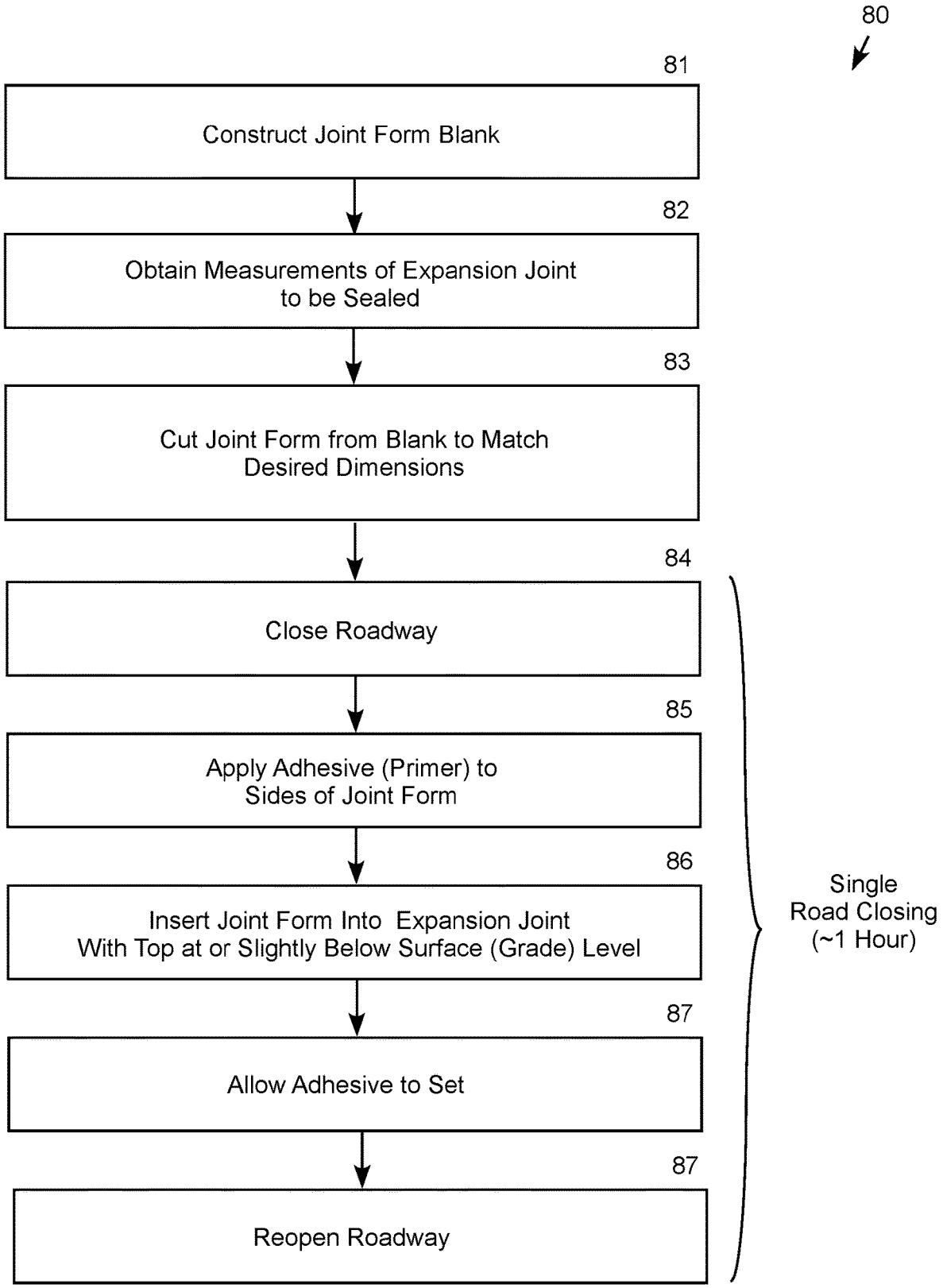
FIG. 8 is a logic flow of a method for using a joint form to seal an expansion joint in a concrete deck.

FIG. 8 is a logic flow of a method 80 for using a joint form to seal an expansion joint. In step 81, a joint form blank including a lower foam block portion (e.g., closed-call polyethylene) bonded to an upper elastomeric seal portion (e.g., closed-call neoprene) is fabricated, typically at a shop location for later use as an expansion joint seal. Step 81 is followed by step 82, in which measurements are obtained of an expansion joint to be sealed. For example, the expansion joint measurements may be obtained during low road usage (e.g., middle of the night), a road closure, or from photographs or engineering specifications. Step 82 is followed by step 83, in which the joint form blank is cut the desired dimensions corresponding to the expansion joint to be sealed for a particular job. In most cases, the joint form used for sealing an expansion joint closely matches the width of the expansion for a snug fit. The length of the joint form may match the length as the expansion joint, although multiple joint forms may be placed end-to-end to span the entire concrete deck to make the installation easier. The height of the joint form may match the height of the expansion or, in some cases, may be configured to fit in an upper portion of the expansion joint. For example, the joint form may be sized to fill the upper three or four inches of an expansion joint that is six or eight inches tall. In addition, the joint form may be positioned to match the surface (grade) level or slightly below the surface level, typically within ¼-inch of the surface, to reduce stress and wear on the top layer of the joint form. Step 83 is followed by step 84, in which the section of the roadway to be sealed is closed, such as the entire roadway or a lane. Step 84 is followed by step 85, in which an adhesive, which in some cases may be the primer typically used with a concrete repair material, is applied to the sides of the joint form. The selected adhesive should have a partial setting time adequate to allow for placement of the joint form in the expansion joint before setting to the point where it impedes movement of the joint form into the expansion joint, such as 20 minutes. Step 85 is followed by step 86, in which the joint form (or series of end-to-end joint forms) is inserted into the expansion joint spanning the desired area to be sealed, which is typically the width of an entire lane or roadway. Step 86 is followed by step 87, in which the adhesive is allowed to set adequately to allow traffic to resume, typically 30 minutes. Step 87 is followed by step 88, in which the lane or roadway is reopened. The joint sealing job is typically completed within a single road or lane closure of about an hour, representing a great improvement over conventional expansion joint sealing procedures.

Figure 10:
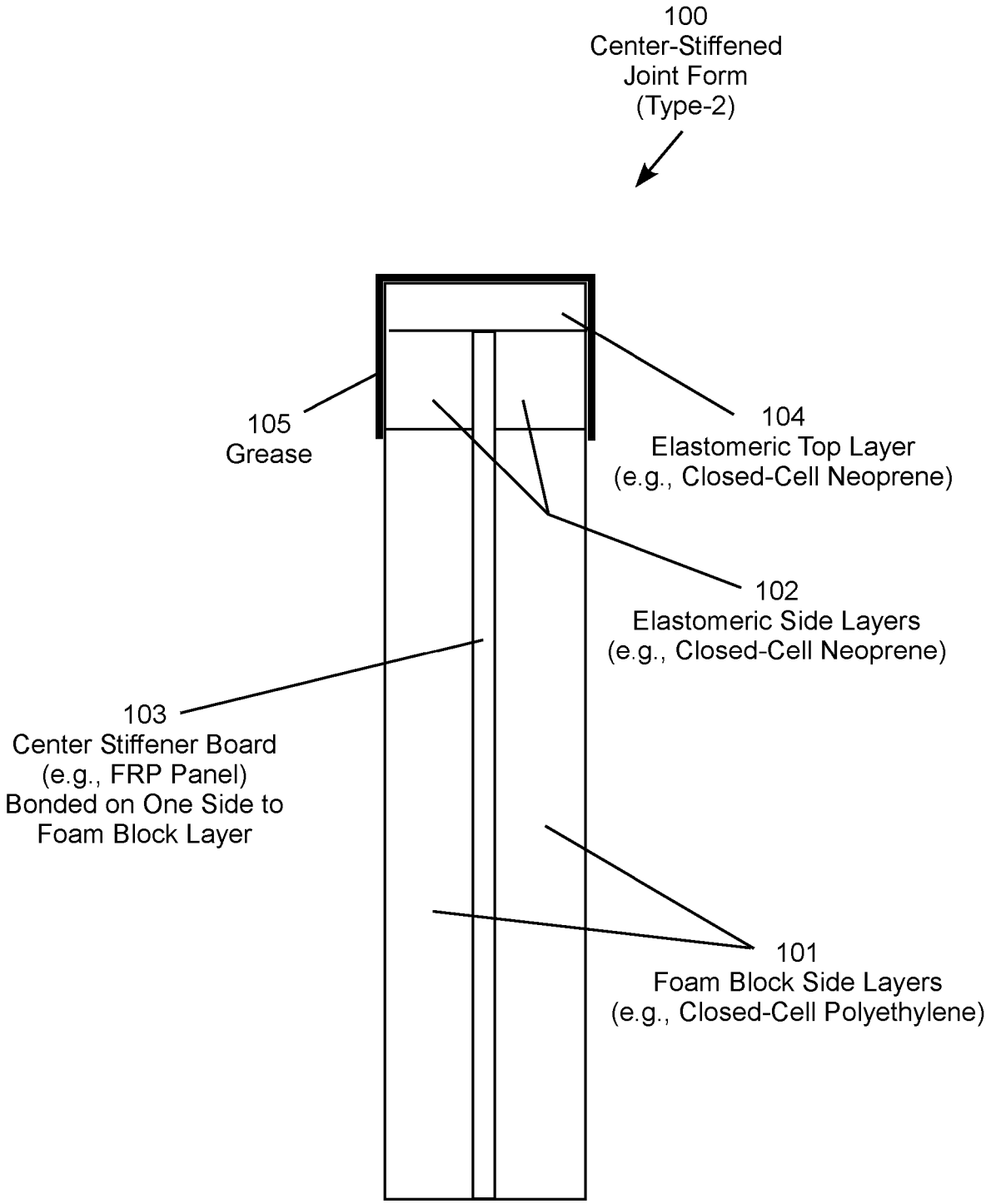
FIG. 10 is a side view of a second alternative joint form with a center stiffener.

Different types of joint forms many be utilized depending on the size and configuration of the concrete damage. The joint form 20 shown in FIGS. 2A-2B represents a Type-0 joint form with no stiffener. FIG. 9 is a side view of a first alternative Type-1 joint form 90 with a side stiffener, and FIG. 10 is a side view of a second alternative Type-2 joint form 100 with a center stiffener. For example, the Type-0 joint form may be selected for sealing applications where little or no concrete damage has occurred to the expansion joint. A Type-1 joint form may be selected when both sides of the expansion joint have experienced significant concrete loss, and the Type-2 joint form may be selected when both sides of the expansion joint have experienced significant concrete loss and relatively large movement occurs. Of course, other factors, such as the height of the concrete deck and need to add additional pieces of foam board to fill hulled-out areas of the concrete slabs, may affect the selection.

The Type-1 side-stiffened joint form 90 shown in FIG. 9 includes a foam block layer 91 (e.g., closed-cell polyethylene) bonded to an upper an elastomeric seal layer 92 (e.g., closed-cell neoprene), with a side stiffener board 93 (e.g., FRP) bonded to one side of the block-seal laminate. The Type-2 center-stiffened joint form 100 shown in FIG. 10 includes two block-seal laminate panels, each including a foam block layer 101 (e.g., closed-cell polyethylene) bonded to an upper an elastomeric seal layer 102 (e.g., closed-cell neoprene) with a center stiffener board 103 (e.g., FRP) bonded to the foam block material on only one side in the center of the block-seal laminate panels. An upper elastomeric seal layer 104 (e.g., closed-cell neoprene) is bonded on top of the three-layer laminate. As an option, only one of the polyethylene portions 101 is glued to the FRP stiffener board 103, with the neoprene portions 102 left unglued to the FRP stiffener board. As another option illustrated in FIG. 10 (which may be applied to all three types of joint form, as desired) grease 105 is applied over the top elastomeric seal layer 104, or over the elastomeric seal layers 102 and 104, to prevent the concrete repair material from bonding to the seal material to provide a cleaner look to the repair.

While particular aspects of the present subject matter have been shown and described in detail, it will be apparent to those skilled in the art that, based upon the teachings of this disclosure, changes and modifications may be made without departing from the subject matter described in this disclosure and its broader aspects and, therefore, the appended claims are to encompass within their scope all such changes and modifications as are within the true spirit and scope of the subject matter described in this disclosure. Although particular embodiments of this disclosure have been illustrated, it is apparent that various modifications and embodiments of the disclosure may be made by those skilled in the art without departing from the scope and spirit of the disclosure.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. The disclosure is defined by the following claims, which should be construed to encompass one or more structures or function of one or more of the illustrative embodiments described above, equivalents and obvious variations. It will therefore be appreciated that the present invention provides significant improvements in electric power circuit reclosers. The foregoing relates only to the exemplary embodiments of the present invention, and that numerous changes may be made therein without departing from the spirit and scope of the invention as defined by the following claims.

The invention claimed is:

1. A method for repairing and sealing concrete damage at an expansion joint in a concrete deck during a single repair event from closing a road section until reopening the road section, wherein the expansion joint comprises an elongated length direction, comprising:

closing the road section comprising the concrete damage at the expansion joint in the concrete deck having a surface level;

obtaining a joint form comprising a foam block lower portion bonded to an elastomeric seal upper portion, wherein the joint form has a width corresponding to a width of the expansion joint, a height corresponding to a height of the expansion joint, and a length of a desired repair greater than a length of the concrete damage;

installing the joint form into the expansion joint spanning the concrete damage in the length direction from a first undamaged portion of the expansion joint on a first side of the concrete damage to a second undamaged portion of the expansion joint on a second side of the concrete damage;

backfilling the concrete damage adjacent to the joint form with a concrete repair material up to or below the surface level;

allowing the concrete repair material to cure and reopening the road section.

2. The method of claim 1, further comprising:

forming a joint form blank prior to the repair event at a location away from a location of the road section having the concrete damage;

at the time of the repair event and at the location of the road section having the concrete damage, trimming the joint form blank to correspond to the width of the expansion joint, the height of the expansion joint, and the length greater than the length of the desired repair.

3. The method of claim 1, further comprising backfilling the concrete damage adjacent to the joint form with the concrete repair material on both sides of the concrete form.

4. The method of claim 1, further comprising backfilling the concrete damage adjacent to the joint form with the concrete repair material on only one side of the concrete form.

5. The method of claim 1, wherein the foam block lower portion comprises polyethylene and the elastomeric seal upper portion comprises neoprene.

6. The method of claim 1, wherein the joint form comprises brushed-on contact cement bonding the foam block lower portion to the elastomeric seal upper portion.

7. The method of claim 1, wherein the joint form further comprises a stiffener board bonded to at least the foam block lower portion of the joint form.

8. The method of claim 7, wherein the stiffener board comprises fiberglass reinforced plastic (FRP).

9. The method of claim 7, wherein the stiffener board is bonded to the foam block lower portion of the joint form with brushed-on catalyzed resin (primer).

10. The method of claim 1, wherein the joint form further comprises a side stiffener board bonded to a selected side of foam block lower portion of the joint form.

11. The method of claim 1, wherein the joint form further comprises a center stiffener board bonded on one side between opposing foam block panels.

12. The method of claim 1, further comprising applying primer to the joint form as a lubricant to facilitate installing the joint form in the expansion joint.

13. The method of claim 1, further comprising sawing a side of the joint form to open closed cells of the joint form to prepare the joint form for bonding to the concrete repair material.

14. A concrete deck with repaired concrete damage at an expansion joint of the concrete deck, wherein the expansion joint comprises an elongated length direction, comprising:

a joint form comprising a foam block lower portion bonded to an elastomeric seal upper portion captured within the expansion joint spanning the repaired concrete damage in the length direction from a first undamaged portion of the expansion joint on a first side of the repaired concrete damage to a second undamaged portion of the expansion joint on a second side of the repaired concrete damage;

concrete repair material backfilling the concrete damage up to or below a surface level of the concrete deck bonded to at least the foam block portion of the joint form.

15. The concrete deck of claim 14, wherein the joint form further comprises a side stiffener board bonded to at least the foam block portion of the joint form.

16. The concrete deck of claim 14, wherein the joint form further comprises a center stiffener board bonded to at least the foam block portion of the joint form.

17. The concrete deck of claim 14, wherein the elastomeric seal portion of the joint form is bonded to the foam portion of the joint form but is not bonded to the concrete repair material.

* * * * *